US011049450B2

(12) United States Patent
Han et al.

(10) Patent No.: US 11,049,450 B2
(45) Date of Patent: Jun. 29, 2021

(54) PIXEL CIRCUIT AND METHOD FOR DRIVING PIXEL CIRCUIT

(71) Applicant: JITRI INSTITUTE OF ORGANIC OPTOELECTRONICS CO., LTD., Jiangsu (CN)

(72) Inventors: Yuanyuan Han, Jiangsu (CN); Chaogan Cao, Jiangsu (CN); Xiaozhao Zhu, Jiangsu (CN); Long Wang, Jiangsu (CN); Man-keung Fung, Jiangsu (CN); Liangsheng Liao, Jiangsu (CN)

(73) Assignee: JITRI INSTITUTE OF ORGANIC OPTOELECTRONICS CO., LTD., Jiangsu (CN)

( * ) Notice: Subject to any disclaimer, the term of this patent is extended or adjusted under 35 U.S.C. 154(b) by 0 days.

(21) Appl. No.: 16/617,784

(22) PCT Filed: Apr. 28, 2018

(86) PCT No.: PCT/CN2018/084996
§ 371 (c)(1),
(2) Date: Nov. 27, 2019

(87) PCT Pub. No.: WO2019/019747
PCT Pub. Date: Jan. 31, 2019

(65) Prior Publication Data

US 2020/0111414 A1 Apr. 9, 2020

(30) Foreign Application Priority Data

Jul. 26, 2017 (CN) ..... 201710617336.6

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01)

(58) Field of Classification Search
CPC .. G09G 3/3233; G09G 3/3266; G09G 3/3291; G09G 3/3225; G09G 3/3258
See application file for complete search history.

(56) References Cited

U.S. PATENT DOCUMENTS 10,395,590 B1 * 8/2019 Lin ..... G09G 3/3275
10,453,392 B2 * 10/2019 Xu ..... G09G 3/3266
(Continued)

FOREIGN PATENT DOCUMENTS

CN 101399005 A 4/2009
CN 101887687 A 11/2010
(Continued)

OTHER PUBLICATIONS

PCT International Search Report for PCT/CN2018/084996 dated Jun. 29, 2018, 6 pages.

*Primary Examiner* — Yuzhen Shen
(74) *Attorney, Agent, or Firm* — Patterson Thuente Pedersen, P.A.

(57) ABSTRACT

A pixel circuit and a pixel circuit driving method. The pixel circuit includes four transistors, two scan signal lines, a data signal line, a control signal line, a capacitor, and a LED. The first transistor has a source electrode connected to a first plate of the capacitor, and a drain electrode connected to a source electrode of the second transistor. A second plate of the capacitor is connected to a drain electrode of the third transistor. The second transistor has a drain electrode connected to a gate electrode of the fourth transistor, and the source electrode connected to the data signal line. The third transistor has a source electrode connected to the power source, and the drain electrode connected to a source elec-
(Continued)

trode of the fourth transistor. A drain electrode of the fourth transistor is connected to the LED. A cathode of the LED is connected to ground.

13 Claims, 6 Drawing Sheets

(56) References Cited

U.S. PATENT DOCUMENTS

| | | | | |
|---|---|---|---|---|
| 10,685,603 | B2 * | 6/2020 | Jeong | G09G 3/3258 |
| 10,698,521 | B2 * | 6/2020 | Yang | G06F 3/0443 |
| 2003/0107565 | A1 | 6/2003 | Libsch et al. | |
| 2005/0067970 | A1 | 3/2005 | Libsch et al. | |
| 2005/0200575 | A1 * | 9/2005 | Kim | G09G 3/3233 345/76 |
| 2005/0264498 | A1 * | 12/2005 | Asano | G09G 3/30 345/76 |
| 2006/0044235 | A1 | 3/2006 | Lee et al. | |
| 2006/0158402 | A1 * | 7/2006 | Nathan | G09G 3/3291 345/82 |
| 2014/0152719 | A1 | 6/2014 | Jung | |
| 2016/0064411 | A1 * | 3/2016 | Park | H01L 27/156 257/89 |
| 2016/0351126 | A1 * | 12/2016 | Qing | G09G 3/3258 |
| 2017/0162120 | A1 * | 6/2017 | Hung | G09G 3/3233 |
| 2017/0243542 | A1 * | 8/2017 | Xiang | G09G 3/3233 |
| 2018/0122297 | A1 * | 5/2018 | Nonaka | G09G 3/325 |
| 2018/0166011 | A1 * | 6/2018 | Zhou | G09G 3/3233 |

FOREIGN PATENT DOCUMENTS

| | | | | | |
|---|---|---|---|---|---|
| CN | 102222468 | A | | 10/2011 | |
| CN | 102651195 | A | | 8/2012 | |
| CN | 103531151 | A | | 1/2014 | |
| CN | 104485074 | A | | 4/2015 | |
| CN | 105513535 | A | | 4/2016 | |
| CN | 106297663 | A | | 1/2017 | |
| CN | 106486063 | A | * | 3/2017 | G09G 3/3233 |
| CN | 106531075 | A | | 3/2017 | |
| CN | 107170413 | A | | 9/2017 | |
| CN | 107437399 | A | | 12/2017 | |

* cited by examiner

PIXEL CIRCUIT AND METHOD FOR DRIVING PIXEL CIRCUIT

CROSS-REFERENCE TO RELATED APPLICATIONS

This is a National Stage Application, filed under 35 U.S.C. 371, of International Patent Application No. PCT/CN2018/084996, filed on Apr. 28, 2018, which claims priority to Chinese patent application No. 201710617336.6 filed on Jul. 26, 2017, contents of both of which are incorporated herein by reference in their entireties.

TECHNICAL FIELD

The present disclosure relates to the field of pixel driving technology and, for example, to a pixel circuit and a pixel circuit driving method.

BACKGROUND

Active-matrix organic light emitting diode (AMOLED) display technology gradually replaces the conventional display technology (such as liquid crystal display) for its advantages of wide color gamut, wide viewing angle, high contrast and low power consumption. In an AMOLED screen, a pixel circuit is used as a signal control circuit of pixels, and plays an important role in a display panel. At present, the defects in the mainstream Low Temperature Poly-silicon (LTPS) process has non-uniform voltage threshold (Vth), so the pixel circuit is mainly used for compensating the Vth. For a product (such as a micro-display) with high pixels per inch (PPI), the line width of the pixel circuit layout diagram is narrowed due to smaller pixel layout space. Therefore, a voltage drop of a supply voltage of a power source is increased, and writing of screen signals is inconsistent. Therefore, non-uniform display is caused.

SUMMARY

In view of this, the present disclosure provides a pixel circuit and a pixel circuit driving method.

The present disclosure provides the pixel circuit provided, which is applied to an AMOLED screen. The pixel circuit includes a first transistor, a second transistor, a third transistor, a fourth transistor, a first scan signal line, a second scan signal line, a data signal line, a control signal line, a capacitor and a light emitting diode (LED).

A gate electrode of the first transistor is connected to the first scan signal line, a source electrode of the first transistor is connected to a first plate of the capacitor, and a drain electrode of the first transistor is connected to a source electrode of the second transistor.

A second plate of the capacitor is connected to a drain electrode of the third transistor.

A gate electrode of the second transistor is connected to the second scan signal line, a drain electrode of the second transistor is connected to a gate electrode of the fourth transistor, and the source electrode of the second transistor is connected to the data signal line.

A source electrode of the third transistor is configured to be connected to a power source, the drain electrode of the third transistor is connected to a source electrode of the fourth transistor, and a gate electrode of the third transistor is connected to the control signal line.

A drain electrode of the fourth transistor is connected to an anode of the LED.

A cathode of the LED is configured to be connected to ground.

The first scan signal line is configured to transmit a control signal to the gate electrode of the first transistor to control the first transistor to turn on or off. The second scan signal line is configured to transmit a control signal to the gate electrode of the second transistor to control the second transistor to turn on or off. The control signal line is configured to transmit a control signal to the gate electrode of the third transistor to control the third transistor to turn on or off.

The present disclosure further provides a pixel circuit driving method, which is applied to the above pixel circuit. The method includes steps described below.

The first scan signal line is configured to transmit a control signal to the gate electrode of the first transistor to control the first transistor to turn on or off.

The second scan signal line is configured to transmit a control signal to the gate electrode of the second transistor to control the second transistor to turn on or off.

The data signal line is configured to write a digital signal transmitted from the data signal line into the fourth transistor through the second transistor.

The digital signal from the data signal line may be written into the capacitor through the first transistor.

A signal from the power source may be written into the fourth transistor through the third transistor.

The present disclosure further provides a pixel circuit driving method, which is applied to the above pixel circuit. The method includes steps described below.

In a first stage, the first scan signal line is configured to control the first transistor to turn on, the second scan signal line is configured to control the second transistor to turn on, and the data signal line is configured to write a first signal at a low level into the gate electrode of the fourth transistor and the first plate of the capacitor.

In a second stage, the first scan signal line is configured to control the first transistor to turn off, the second scan signal line is configured to control the second transistor to turn on, and the data signal line is configured to write a second signal at a high level into the gate electrode of the fourth transistor to clamp a voltage at the source of the fourth transistor to a third signal. The third signal is determined by the second signal and a threshold voltage of the fourth transistor.

In a third stage, the first scan signal line is configured to control the first transistor to turn on, the control signal line is configured to control the third transistor to turn on, to make a voltage at the source electrode of the fourth transistor equal to a supply voltage of the power source. Under a coupling action of the capacitor, a voltage at the gate electrode of the fourth transistor is clamped to a fourth signal. The fourth signal is determined by the first signal, the third signal and the supply voltage.

According to the pixel circuit and the pixel circuit driving method provided by the present disclosure, the effect of the supply voltage and the threshold voltage of the fourth transistor can be effectively cancelled through fewer transistors and capacitors, so that the display of a display connected to the pixel circuit is more uniform. In addition, the pixel circuit provided by the present disclosure has the advantages of simple structure, less signals and relatively simpler circuit layout. Therefore, it is beneficial to the layout of the pixel circuit.

DESCRIPTION OF DRAWINGS

In order to more clearly describe the embodiments of the present disclosure, the drawings required in the embodiments are briefly described below. It should be understood that the following drawings only show some embodiments of the present disclosure and should not be considered as the limitation of the scope.

REFERENCE SIGNS

Figure 1:
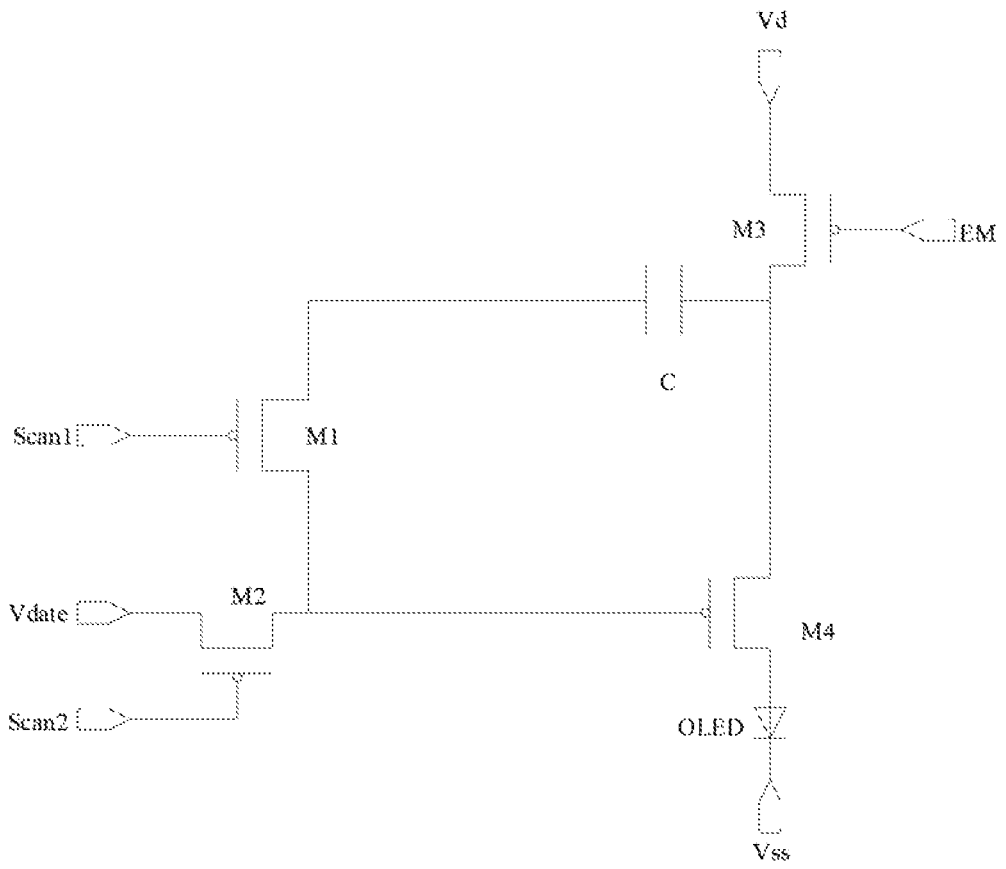
FIG. 1 is a structural diagram of a pixel circuit provided by an embodiment of the present disclosure.

M1: First transistor; M2: Second transistor; M3: Third transistor; M4: Fourth transistor; M5: Fifth transistor; M6: Sixth transistor; Scan1: First scan signal line; Scan2: Second scan signal line; Vdate: Data signal line; EM: Control signal line; OLED: Organic light emitting diode; Vd: Power source; C: Capacitor; Vss: Ground power source.

DETAILED DESCRIPTION

The embodiments of the present disclosure will be described below in conjunction with the drawings in the embodiments of the present disclosure. Obviously, the described embodiments are only some, but not all embodiments of the present disclosure. The following detailed description of the embodiments of the present disclosure provided in the drawings is not intended to limit the protection scope of the present disclosure, and is only representative of selected embodiments of the present disclosure.

It should be noted that similar reference numbers and letters in the following drawings refer to similar items. Therefore, once an item is defined in one figure, the item does not need to be further defined and explained in subsequent figures. Meanwhile, in the description of the present disclosure, the terms such as "first" and "second" are only used for distinguishing descriptions and are not to be understood as indicating or implying relative importance.

First Embodiment

The embodiment provides a pixel circuit. As shown in FIG. 1, the pixel circuit includes a first transistor M1, a second transistor M2, a third transistor M3, a fourth transistor M4, a first scan signal line Scan1, a second scan signal line Scan2, a data signal line Vdate, a control signal line EM, a capacitor C and a light emitting diode LED.

In the embodiment, a gate electrode of the first transistor M1 is connected to the first scan signal line Scan1, a source electrode of the first transistor M1 is connected to a first plate of the capacitor C, and a drain electrode of the first transistor M1 is connected to a source electrode of the second transistor M2.

Figure 3:
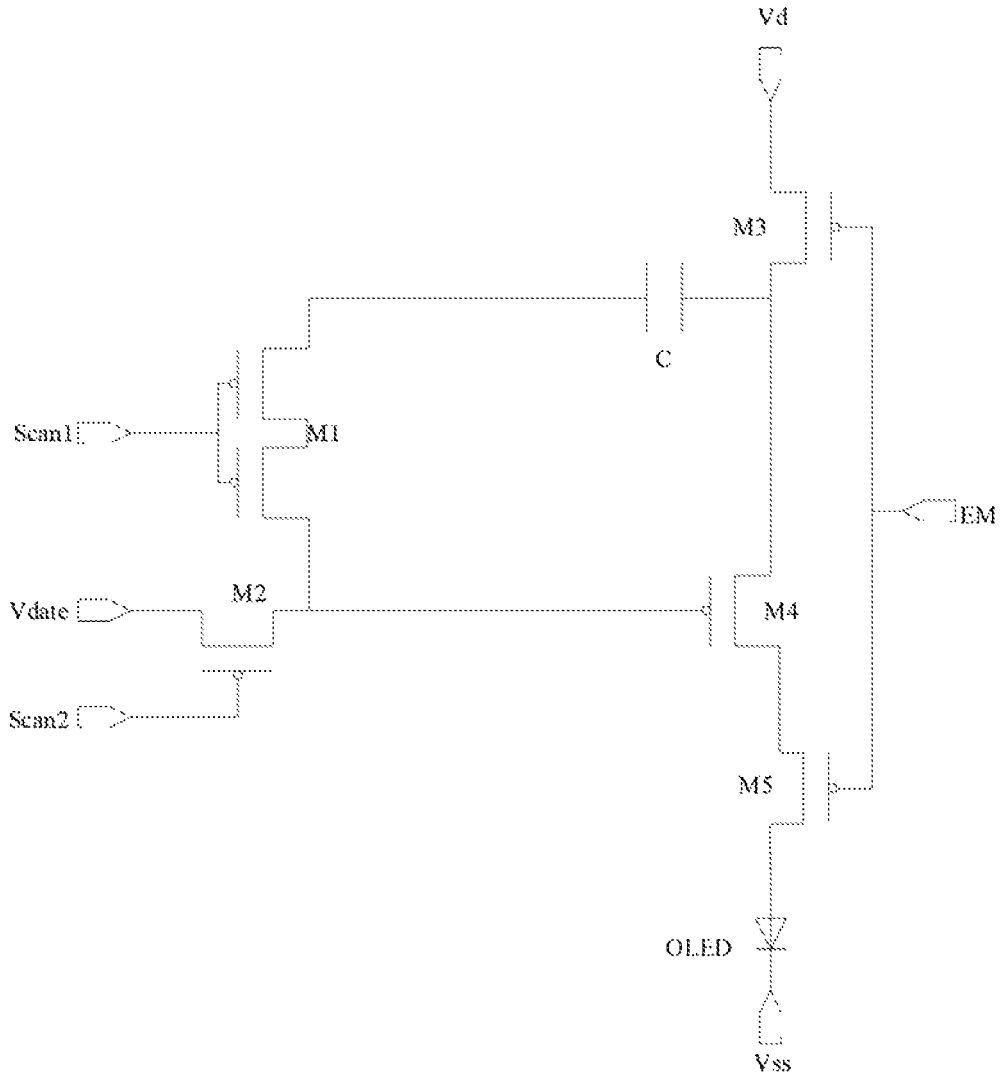
FIG. 3 is a structural diagram of another pixel circuit provided by an embodiment of the present disclosure.
Figure 4:
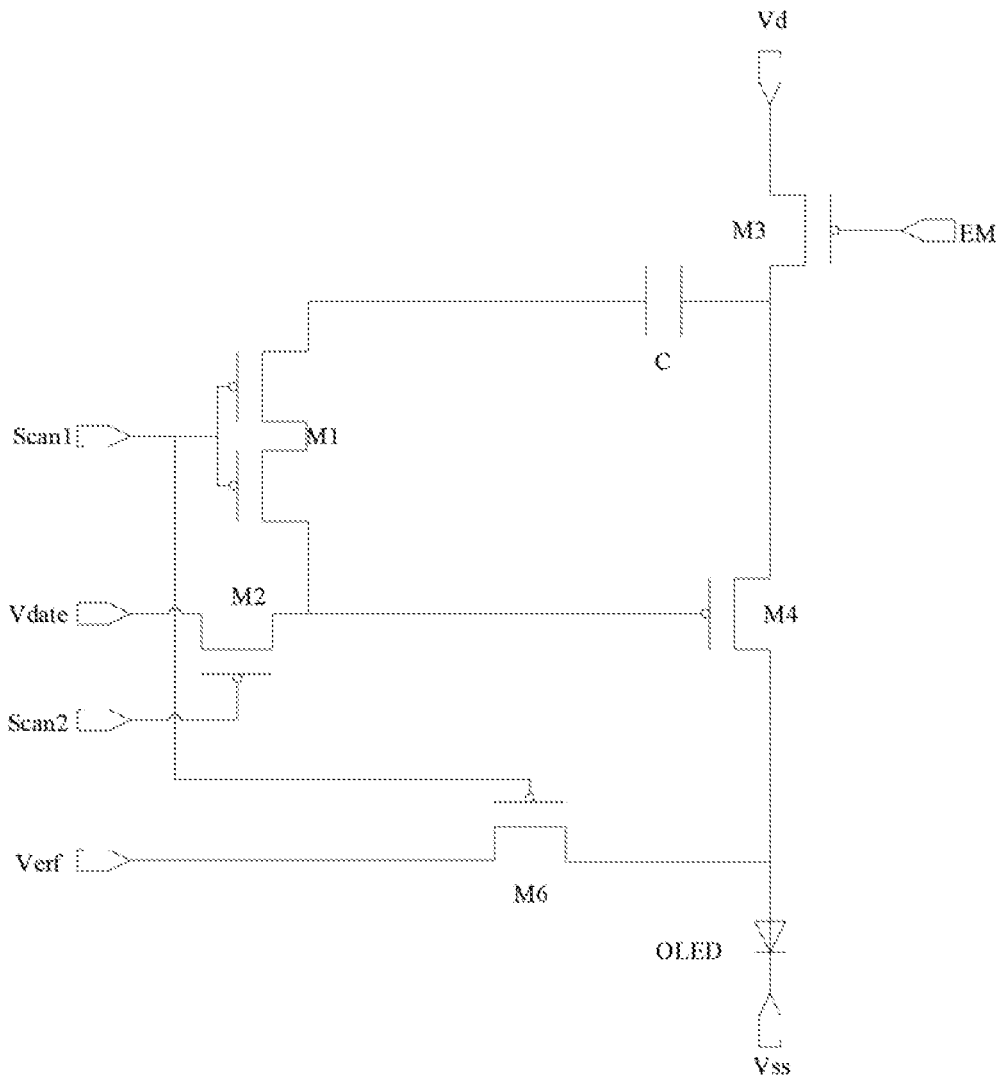
FIG. 4 is a structural diagram of another pixel circuit provided by an embodiment of the present disclosure.

In an implementation, as shown in FIG. 3, the first transistor M1 may be a dual-gate transistor, and both gates of the first transistor M1 are connected to the first scan signal line Scan1. Leakage current may be significantly reduced through using the dual-gate transistor, so that the stability of a signal of the capacitor C connected to the first transistor M1 is improved.

In the embodiment, a second plate of the capacitor C is connected to a drain electrode of the third transistor M3.

In the embodiment, a gate electrode of the second transistor M2 is connected to the second scan signal line Scan2, a drain electrode of the second transistor M2 is connected to a gate electrode of the fourth transistor M4, and the source electrode of the second transistor M2 is connected to the data signal line Vdata.

In the embodiment, a source electrode of the third transistor M3 is configured to be connected to a power source Vd, the drain electrode of the third transistor M3 is connected to a source electrode of the fourth transistor M4, and a gate electrode of the third transistor M3 is connected to the control signal line EM.

In the embodiment, a drain electrode of the fourth transistor M4 is connected to an anode of the LED. A cathode of the LED is connected to ground. As shown in FIG. 1, the LED is connected to a ground power source Vss.

In the embodiment, the first scan signal line Scan1 is configured to transmit a control signal to the gate electrode of the first transistor M1 to control the first transistor M1 to turn on or off. The second scan signal line Scan2 is configured to transmit a control signal to the gate electrode of the second transistor M2 to control the second transistor M2 to turn on or off. The control signal line EM is configured to transmit a control signal to the gate electrode of the third transistor M3 to control the third transistor M3 to turn on or off.

In an embodiment, each of the first transistor M1, the second transistor M2, the third transistor M3 and the fourth transistor M4 may be made of N-type Metal-Oxide Semiconductor (NMOS), or P-type Metal-Oxide Semiconductor (PMOS).

In an implementation, the pixel circuit may be driven through following three stages to implement that the pixel circuit cancels a supply voltage of the power source and a threshold voltage of the fourth transistor M4.

In a first stage, the first scan signal line Scan1 is configured to control the first transistor M1 to turn on, the second scan signal line Scan2 is configured to control the second transistor M2 to turn on, and the data signal line is configured to write a first signal at a low level into the gate electrode of the fourth transistor M4 and the first plate of the capacitor C.

In a second stage, the first scan signal line Scan1 is configured to control the first transistor M1 to turn off, the second scan signal line Scan2 is configured to control the second transistor M2 to turn on, and the data signal line Vdate is configured to write a second signal at a high level into the gate electrode of the fourth transistor M4 to clamp a voltage at the source of the fourth transistor M4 to a third signal. The third signal is determined by the second signal and the threshold voltage of the fourth transistor M4.

In a third stage, the first scan signal line Scan1 is configured to control the first transistor M1 to turn on, the control signal line EM is configured to control the third transistor M3 to turn on, to make a voltage at the source electrode of the fourth transistor M4 equal to the supply voltage. Under a coupling action of the capacitor C, a voltage at the gate electrode of the fourth transistor M4 is clamped to a fourth signal. The fourth signal is determined by the first signal, the third signal and the supply voltage.

Figure 2:
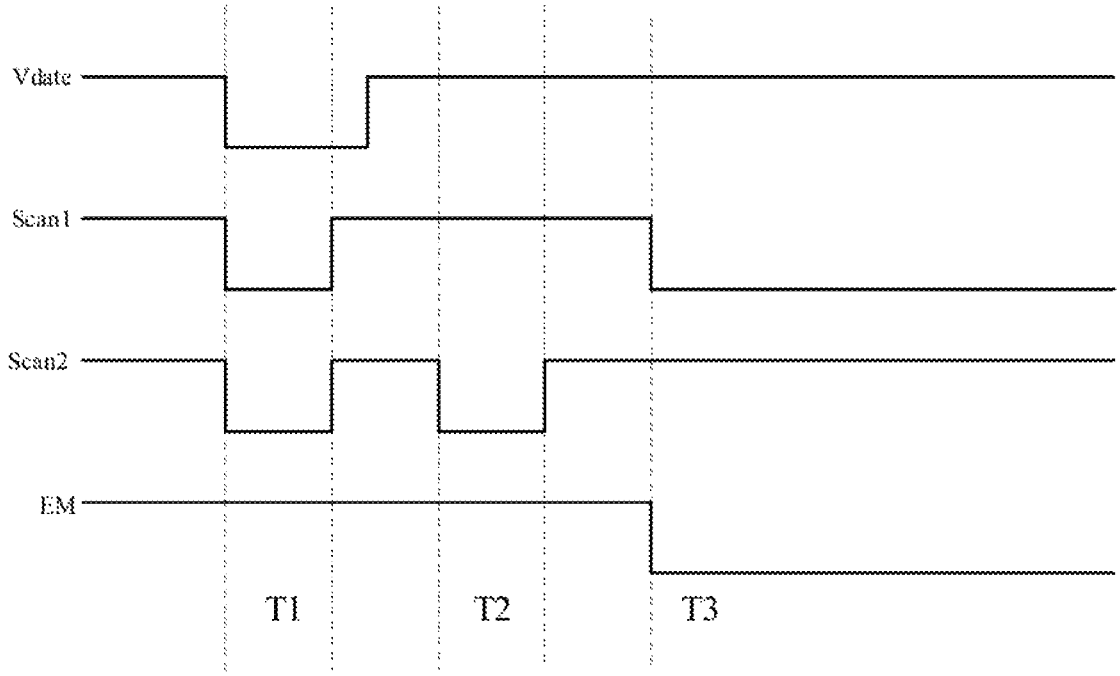
FIG. 2 is a timing diagram of a pixel circuit provided by an embodiment of the present disclosure.

In an example, a transistor is turned on when a low level is inputted at a gate electrode of the transistor. As shown in FIG. 2, in the first stage T1, the first scan signal line Scan1 and the second scan signal line Scan2 respectively provide a low level to control the first transistor M1 and the second transistor M2 to turn on. The data signal line Vdate is configured to write a first signal at a low level into the gate electrode of the fourth transistor M4 and the first plate of the capacitor C. In an example, the first signal is recorded as Vdate1. In other examples, the transistors in the embodiment may further be turned on when a high level is inputted at the gate electrode of the transistor. The embodiment of the present disclosure is not limited to the manner in which the transistors are turned on or off. The following is an example of the transistor being turned on when a low level is inputted at the gate electrode of the transistor.

In the second stage T2, the first scan signal line Scan1 provides a high level, and the first transistor M1 is turned off after receiving a signal provided by the first scan signal line Scan1. The second scan signal line Scan2 provides a low level, and the second transistor M2 is turned on after receiving a signal provided by the second scan signal line Scan2. At this time, the data signal line Vdate outputs a second signal at a high level. The fourth transistor M4 is turned off after receiving the second signal output from the data signal line Vdate. The voltage at the source electrode of the fourth transistor M4 is clamped to the third signal. The third signal is determined by the second signal input from the data signal line Vdate and the threshold voltage of the fourth transistor M4. In an example, the second signal is recorded as Vdate2, the threshold voltage is recorded as Vth, and the third signal is recorded as Vdate2−Vth.

In the third stage T3, the second scan signal line Scan2 provides a high level to control the second transistors M2 to turn off. The first scan signal line Scan1 and the control signal line EM provide a low level, and the first transistor M1 and the third transistor M3 are turned on after receiving a signal at the low level. At this time, the voltage at the source electrode of the fourth transistor M4 is the supply voltage. In an example, the supply voltage of the power source Vd is recorded as Vdd. Under the coupling action of the capacitor C, a voltage at the gate electrode of the fourth transistor M4 is recorded as Vdata1+(Vdd−Vdata2+Vth).

A difference between the voltage at the gate electrode of the fourth transistor M4 and the voltage at the source electrode of the fourth transistor M4 in the third stage T3 is the following:

$$\begin{aligned} Vgs &= Vdata1 + (Vdd - Vdata2 + Vth) - Vdd \\ &= Vdata1 - (Vdata2 - Vth). \end{aligned}$$

Vgs represents the difference between the voltage at the gate electrode of the fourth transistor M4 and the voltage at the source electrode of the fourth transistor M4, Vdate1 represents the first signal, Vdate2 represents the second signal, Vth represents the threshold voltage of the fourth transistor M4, and Vdd represents the supply voltage.

At this time, a current flowing through the fourth transistor M4 is the following:

$$\begin{aligned} Ids &= \frac{\beta}{2}(Vgs - Vth)^2 \\ &= \frac{\beta}{2}\{(Vdate1 - (Vdate2 - Vth) - Vth\}^2 \\ &= \frac{\beta}{2}(Vdate1 - Vdate2)^2. \end{aligned}$$

Ids represents the current flowing through the fourth transistor M4, and β represents an amplification factor of the fourth transistor M4.

From the above calculation result of Ids, it should be known that the current flowing through the fourth transistor M4 at this time is not affected by the supply voltage and the threshold voltage of the fourth transistor M4. The pixel circuit can effectively cancel the effect of the supply voltage and the threshold voltage of the fourth transistor M4 on the display effect of the LED under the condition of using fewer components. In addition, the pixel circuit provided by the embodiment of the present disclosure has the advantages of simple structure, less signals and relatively simpler circuit layout. Therefore, it is beneficial to the layout of the pixel circuit.

Second Embodiment

The embodiment provides a pixel circuit. The embodiment is similar to the first embodiment except that the pixel circuit in the embodiment is added with a fifth transistor M5 compared with the pixel circuit in the first embodiment. As shown in FIG. 3, the pixel circuit further includes the fifth transistor M5.

In the embodiment, a drain electrode of the fifth transistor M5 is connected to the anode of the LED, a source electrode of the fifth transistor M5 is connected to the drain electrode of the fourth transistor M4, and a gate electrode of the fifth transistor M5 is connected to the control signal line EM. The control signal line EM is configured to transmit a control signal to the gate electrode of the fifth transistor M5 to control the fifth transistor M5 to turn on or off.

Other details about the embodiment may be referred to the description in the first embodiment, and are not described herein again.

According to the pixel circuit in the embodiment, the fifth transistor M5 is added on the basis of the first embodiment. Therefore, the brightness anomaly of the LED, caused by the leakage current flowing into the LED when the fourth transistor M4 is in an off state, can be effectively prevented.

Third Embodiment

Figure 5:
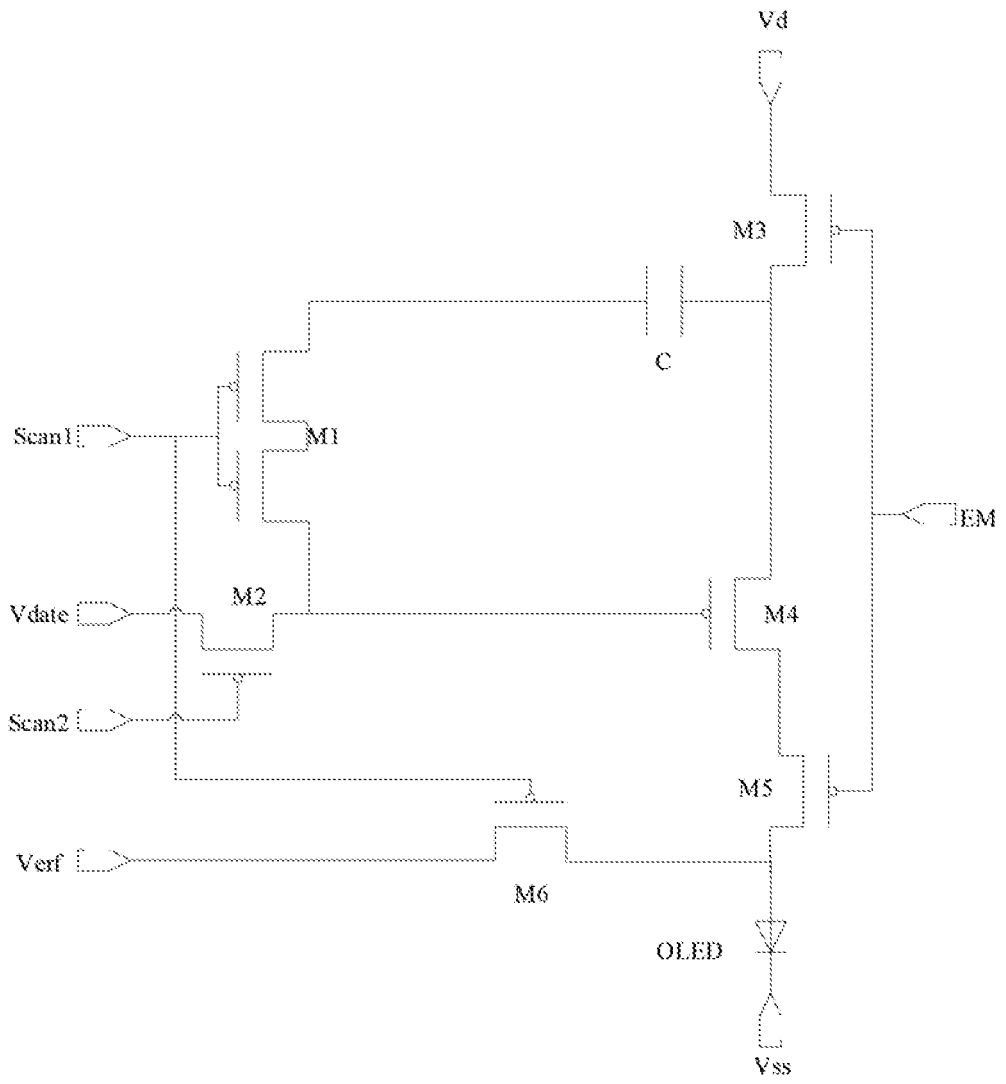
FIG. 5 is a structural diagram of another pixel circuit provided by an embodiment of the present disclosure.

The embodiment provides a pixel circuit. The embodiment is similar to the first embodiment except that the pixel circuit in the embodiment is added with a sixth transistor M6 and a reference level signal line compared with the pixel circuit in the first embodiment. Referring to FIG. 5, the pixel circuit further includes the sixth transistor M6 and a reference level signal line Verf.

In the embodiment, a gate electrode of the sixth transistor M6 is connected to the first scan signal line Scan1, and a drain electrode of the sixth transistor M6 is connected to the LED. The first scan signal line Scan1 is configured to transmit a control signal line to the gate electrode of the sixth transistor M6 to control the sixth transistor M6 to turn on or off.

The reference level signal line Verf is connected to a source electrode of the sixth transistor M6. The reference level signal line Verf is configured to provide an initial current to flow into the LED through the sixth transistor M6 to initialize the LED.

Other details about the embodiment may be referred to the description in the first embodiment, and are not described herein again.

According to the pixel circuit in the embodiment, the sixth transistor M6 and the reference level signal line Verf are added, and the LED is initialized through the reference level signal line Verf providing a signal. Therefore, the effect of a parasitic charge of the LED on the signal received later is prevented, and the stability of the LED is improved.

In other embodiments, as shown in FIG. 5, the pixel circuit may include all the elements of the first embodiment, the second embodiment and the third embodiment. Other contents about the embodiment may be referred to the descriptions in the first, second and third embodiments, and are not described in detail herein again.

Fourth Embodiment

The embodiment provides a pixel circuit deriving method. The method includes steps described below.

The first scan signal line Scan1 is configured to transmit a control signal to the gate source of the first transistor M1 to control the first transistor M1 to turn on or turn off.

The second scan signal line Scan2 is configured to transmit a control signal to the gate source of the second transistor M2 to control the second transistor M2 to turn on or turn off.

The data signal line Vdate is configured to write a digital signal transmitted from the data signal line into the fourth transistor M4 through the second transistor M2.

The digital signal from the data signal line Vdate may be written into the capacitor C or the fourth transistor M4 through the first transistor M1.

A signal from the power source may be written to the fourth transistor M4 through the third transistor M3.

Figure 6:
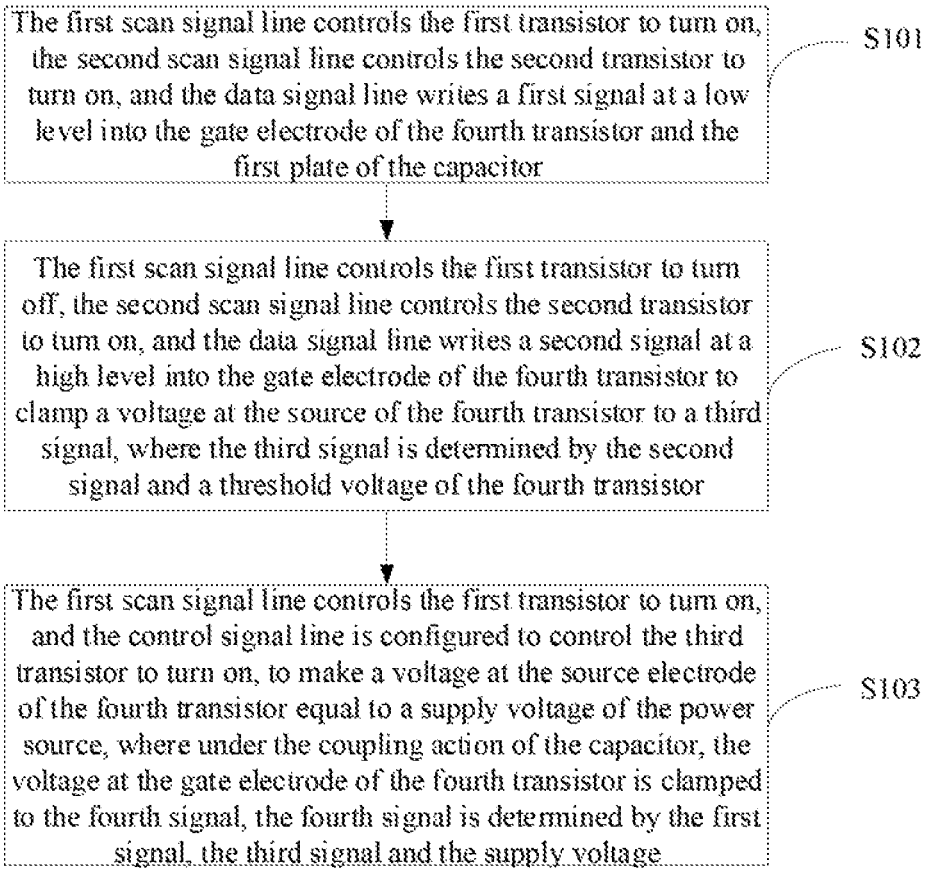
FIG. 6 is a flowchart of a pixel circuit driving method provided by an embodiment of the present disclosure.

In an implementation, the pixel circuit driving method in the embodiment controls the pixel circuit through three stages. The above method may be applied to any pixel circuit. As shown in FIG. 6, the above method includes steps described below.

In a first stage 101, the first scan signal line Scan1 is configured to control the first transistor M1 to turn on, the second scan signal line Scan2 configured to control the second transistor M2 to turn on, and the data signal line Vdate is configured to write a first signal at a low level into the gate electrode of the fourth transistor M4 and the first plate of the capacitor C.

In a second stage 102, the first scan signal line Scan1 is configured to control the first transistor M1 to turn off, the second scan signal line Scan2 is configured to control the second transistor M2 to turn on, and the data signal line Vdate is configured to write a second signal at a high level into the gate electrode of the fourth transistor M4 to clamp a voltage at the source of the fourth transistor M4 to a third signal. The third signal is determined by the second signal and a threshold voltage of the fourth transistor.

In a third stage 103, the first scan signal line Scan1 is configured to control the first transistor M1 to turn on, and the control signal line EM is configured to control the third transistor M3 to turn on, to make a voltage at the source electrode of the fourth transistor M4 equal to a supply voltage of the power source Vd. Under the coupling action of the capacitor C, the voltage at the gate electrode of the fourth transistor M4 is clamped to the fourth signal. The fourth signal is determined by the first signal, the third signal and the supply voltage.

In the embodiment, the third signal in the second stage 102 is a difference between the second signal and the threshold voltage of the fourth transistor M4.

The difference between the voltage at the gate electrode of the fourth transistor M4 and the voltage at the source electrode of the fourth transistor M4 in the third stage 103 is the following:

$$\begin{aligned} Vgs &= Vdata1 + (Vdd - Vdata2 + Vth) - Vdd \\ &= Vdata1 - (Vdata2 - Vth). \end{aligned}$$

Vgs represents the difference between the voltage at the gate electrode of the fourth transistor and the voltage at the source electrode of the fourth transistor, Vdate1 represents the first signal, Vdate2 represents the second signal, Vth represents the threshold voltage of the fourth transistor, and Vdd represents the supply voltage.

At this time, a current flowing through the fourth transistor is the following:

$$\begin{aligned} Ids &= \frac{\beta}{2}(Vgs - Vth)^2 \\ &= \frac{\beta}{2}\{(Vdate1 - (Vdate2 - Vth) - Vth\}^2 \\ &= \frac{\beta}{2}(Vdate1 - Vdate2)^2. \end{aligned}$$

Ids represents the current flowing through the fourth transistor, and β represents an amplification factor of the fourth transistor.

In the embodiment, when the pixel circuit includes the fifth transistor M5 connected between the fourth transistor M4 and the LED, the method further includes a following step: when a current flows through the fourth transistor M4, the current flows into the LED after the current flows through the fifth transistor M5.

In the embodiment, when the pixel circuit includes the sixth transistor M6 and the reference level signal line, the method further includes a following step: the first scan signal line Scan1 is configured to transmit an initialization control signal to the sixth transistor M6 to control the sixth transistor M6 to turn on. The reference level signal line is configured to provide an initial current to flow into the LED through the six transistor M6, to initialize the LED.

Other details about the embodiment may be referred to the descriptions in the first, second and third embodiments, and are not described herein again.

According to the method in the embodiment, the effect of the power supply voltage and the threshold voltage of the fourth transistor can be effectively cancelled through fewer transistors and capacitors, so that the display of a display connected with the pixel circuit is more uniform. In addition, the pixel circuit provided by the embodiment of the present disclosure has the advantages of simple structure, less signals and relatively simpler circuit layout. Therefore, it is beneficial to the layout of the pixel circuit.

INDUSTRIAL APPLICABILITY

According to the pixel circuit and the pixel circuit driving method provided by the present disclosure, the effect of the supply voltage and the threshold voltage of the fourth transistor can be effectively cancelled through fewer transistors and capacitors, so that the display of the LED is more uniform. The structure of the pixel circuit is simple, which is beneficial to the layout of the pixel circuit.

What is claimed is:

1. A pixel circuit, applied to an active-matrix organic light emitting diode (AMOLED) screen, comprising a first transistor, a second transistor, a third transistor, a fourth transistor, a first scan signal line, a second scan signal line, a data signal line, a control signal line, a capacitor and a light emitting diode (LED);

wherein a gate electrode of the first transistor is connected to the first scan signal line, a source electrode of the first transistor is connected to a first plate of the capacitor, and a drain electrode of the first transistor is connected to a drain electrode of the second transistor;

a second plate of the capacitor is connected to a drain electrode of the third transistor;

a gate electrode of the second transistor is connected to the second scan signal line, the drain electrode of the second transistor is connected to a gate electrode of the fourth transistor, and a source electrode of the second transistor is connected to the data signal line;

a source electrode of the third transistor is configured to be connected to a power source, the drain electrode of the third transistor is connected to a source electrode of the fourth transistor, and a gate electrode of the third transistor is connected to the control signal line;

a drain electrode of the fourth transistor is connected to an anode of the LED;

a cathode of the LED is configured to be connected to ground;

wherein the first scan signal line is configured to transmit a control signal to the gate electrode of the first transistor to control the first transistor to turn on or off; the second scan signal line is configured to transmit a control signal to the gate electrode of the second transistor to control the second transistor to turn on or off; the control signal line is configured to transmit a control signal to the gate electrode of the third transistor to control the third transistor to turn on or off; and wherein a current Ids flowing through the fourth transistor is obtained under a coupling action of the one capacitor and by controlling the three transistors comprising the first transistor, the second transistor and the third transistor to turn on or off, wherein the current Ids flowing through the fourth transistor is calculated by a first signal at a low level written into the gate electrode of the fourth transistor through the data signal line in a first stage and a second signal at a high level written into the gate electrode of the fourth transistor through the data signal line in a second stage;

wherein the pixel circuit further comprises a sixth transistor and a reference level signal line;

wherein a gate electrode of the sixth transistor is connected to the first scan signal line, a drain electrode of the sixth transistor is connected to the LED, and a source electrode of the sixth transistor is connected to the reference level signal line; the first scan signal line is configured to transmit a control signal to the gate electrode of the sixth transistor to control the sixth transistor to turn on or off; and the reference level signal line is configured to provide an initial current to flow into the LED through the sixth transistor to initialize the LED.

2. The pixel circuit of claim 1, wherein the first transistor is a dual-gate transistor, and both gates of the first transistor are connected to the first scan signal line.

3. The pixel circuit of claim 2, wherein the AMOLED screen is a micro AMOLED screen.

4. The pixel circuit of claim 2, wherein the AMOLED screen is a silicon-based AMOLED screen.

5. The pixel circuit of claim 1, further comprising a fifth transistor, wherein a drain electrode of the fifth transistor is connected to the anode of the LED, a source electrode of the fifth transistor is connected to the drain electrode of the fourth transistor, a gate electrode of the fifth transistor is connected to the control signal line, the control signal line is configured to transmit a control signal to the gate electrode of the fifth transistor to control the fifth transistor to turn on or off.

6. The pixel circuit of claim 5, wherein the AMOLED screen is a micro AMOLED screen.

7. The pixel circuit of claim 5, wherein the AMOLED screen is a silicon-based AMOLED screen.

8. The pixel circuit of claim 1, wherein the AMOLED screen is a micro AMOLED screen.

9. The pixel circuit of claim 8, wherein the AMOLED screen is a silicon-based AMOLED screen.

10. The pixel circuit of claim 1, wherein the AMOLED screen is a silicon-based AMOLED screen.

11. A pixel circuit driving method, applied to a pixel circuit, wherein the pixel circuit is applied to an active-matrix organic light emitting diode (AMOLED) screen and comprises a first transistor, a second transistor, a third transistor, a fourth transistor, a first scan signal line, a second scan signal line, a data signal line, a control signal line, a capacitor and a light emitting diode (LED);

wherein a gate electrode of the first transistor is connected to the first scan signal line, a source electrode of the first transistor is connected to a first plate of the capacitor, and a drain electrode of the first transistor is connected to a drain electrode of the second transistor;

a second plate of the capacitor is connected to a drain electrode of the third transistor;

a gate electrode of the second transistor is connected to the second scan signal line, the drain electrode of the second transistor is connected to a gate electrode of the fourth transistor, and the source electrode of the second transistor is connected to the data signal line;

a source electrode of the third transistor is configured to be connected to a power source, the drain electrode of the third transistor is connected to a source electrode of the fourth transistor, and a gate electrode of the third transistor is connected to the control signal line;

a drain electrode of the fourth transistor is connected to an anode of the LED;

a cathode of the LED is configured to be connected to ground;

wherein the first scan signal line is configured to transmit a control signal to the gate electrode of the first transistor to control the first transistor to turn on or off; the second scan signal line is configured to transmit a control signal to the gate electrode of the second transistor to control the second transistor to turn on or off; the control signal line is configured to transmit a control signal to the gate electrode of the third transistor to control the third transistor to turn on or off; and wherein a current Ids flowing through the fourth transistor is obtained under a coupling action of the one capacitor and by controlling the three transistors comprising the first transistor, the second transistor and the third transistor to turn on or off, wherein the current Ids flowing through the fourth transistor is calculated by a first signal at a low level written into the gate electrode of the fourth transistor through the data signal line in a first stage and a second signal at a high level written into the gate electrode of the fourth transistor through the data signal line in a second stage;

wherein the pixel circuit further comprises a sixth transistor and a reference level signal line:

wherein a gate electrode of the sixth transistor is connected to the first scan signal line, a drain electrode of the sixth transistor is connected to the LED, and a source electrode of the sixth transistor is connected to the reference level signal line; the first scan signal line is configured to transmit a control signal to the gate electrode of the sixth transistor to control the sixth transistor to turn on or off; and the reference level signal line is configured to provide an initial current to flow into the LED through the sixth transistor to initialize the LED;

wherein pixel circuit driving method comprises:

a first stage: using the first scan signal line to control the first transistor to turn on, using the second scan signal line to control the second transistor to turn on, and using the data signal line to write a first signal at a low level into the gate electrode of the fourth transistor and the first plate of the capacitor;

a second stage: using the first scan signal line to control the first transistor to turn off, using the second scan signal line to control the second transistor to turn on, and using the data signal line to write a second signal at a high level into the gate electrode of the fourth transistor to clamp a voltage at the source of the fourth transistor to a third signal, wherein the third signal is determined by the second signal and a threshold voltage of the fourth transistor; and a third stage: using the first scan signal line to control the first transistor to turn on, using the control signal line to control the third transistor to turn on, to make a voltage at the source electrode of the fourth transistor equal to a supply voltage of the power source; wherein under a coupling action of the capacitor, a voltage at the gate electrode of the fourth transistor is clamped to a fourth signal, wherein the fourth signal is determined by the first signal, the third signal and the supply voltage;

wherein the pixel circuit driving method further comprises:

using the first scan signal line to transmit an initialization control signal to the sixth transistor to control the sixth transistor to turn on, and using the reference level signal line to provide an initial current to flow into the LED through the six transistor, to initialize the LED.

12. The pixel circuit driving method of claim 11, wherein the third signal in the second stage is a difference between the second signal and the threshold voltage of the fourth transistor;

a difference between a voltage at the gate electrode of the fourth transistor and the voltage at the source electrode of the fourth transistor in the third stage is:

$$\begin{aligned} Vgs &= Vdata1 + (Vdd - Vdata2 + Vth) - Vdd \\ &= Vdata1 - (Vdata2 - Vth); \end{aligned}$$

wherein Vgs represents the difference between the voltage at the gate electrode of the fourth transistor and the voltage at the source electrode of the fourth transistor, Vdate1 represents the first signal, Vdate2 represents the second signal, Vth represents the threshold voltage of the fourth transistor, and Vdd represents the supply voltage;

a current flowing through the fourth transistor is:

$$\begin{aligned} Ids &= \frac{\beta}{2}(Vgs - Vth)^2 \\ &= \frac{\beta}{2}\{(Vdate1 - (Vdate2 - Vth) - Vth\}^2 \\ &= \frac{\beta}{2}(Vdate1 - Vdate2)^2; \end{aligned}$$

wherein Ids represents the current flowing through the fourth transistor, and β represents an amplification factor of the fourth transistor.

13. The pixel circuit driving method of claim 11, wherein in a case where the pixel circuit comprises a fifth transistor connected between the fourth transistor and the LED, in a case where a current flows through the fourth transistor, the current flows into the LED after the current flows through the fifth transistor.

* * * * *